US010741926B2

(12) United States Patent
Lee et al.

(10) Patent No.: US 10,741,926 B2
(45) Date of Patent: Aug. 11, 2020

(54) SLOT ANTENNA STRUCTURE FOR ELECTRONIC TAG

(71) Applicant: Compal Electronics, Inc., Taipei (TW)

(72) Inventors: Li-Chun Lee, Taipei (TW); Shih-Chia Liu, Taipei (TW); Yen-Hao Yu, Taipei (TW); Jhin-Ciang Chen, Taipei (TW); Chao-Lin Wu, Taipei (TW); Jui-Hung Lai, Taipei (TW)

(73) Assignee: Compal Electronics, Inc., Taipei (TW)

( * ) Notice: Subject to any disclaimer, the term of this patent is extended or adjusted under 35 U.S.C. 154(b) by 563 days.

(21) Appl. No.: 15/408,428

(22) Filed: Jan. 18, 2017

(65) Prior Publication Data

US 2017/0207544 A1 Jul. 20, 2017

Related U.S. Application Data

(60) Provisional application No. 62/280,095, filed on Jan. 18, 2016.

(51) Int. Cl.

| | |
|---|---|
| ***H01Q 13/16*** | (2006.01) |
| ***H01Q 1/22*** | (2006.01) |
| ***H01Q 1/38*** | (2006.01) |
| ***H01Q 13/10*** | (2006.01) |

(52) U.S. Cl.

CPC ..... *H01Q 13/16* (2013.01); *H01Q 13/103* (2013.01); *H01Q 1/2208* (2013.01); *H01Q 1/2283* (2013.01); *H01Q 1/38* (2013.01)

(58) Field of Classification Search

CPC ..... H01Q 13/10; H01Q 13/085; H01Q 1/38; H01Q 1/3291; H01Q 13/16; H01Q 13/103; H01Q 1/2208; H01Q 1/2283

USPC ..... 343/767, 741, 772, 789, 855

See application file for complete search history.

(56) References Cited

U.S. PATENT DOCUMENTS

| | | | | |
|---|---|---|---|---|
| 5,642,120 | A * | 6/1997 | Fujisawa | H01Q 1/22 343/702 |
| 2010/0231482 | A1* | 9/2010 | Yoshida | G06K 19/07749 343/904 |
| 2013/0126622 | A1* | 5/2013 | Finn | G06K 19/07771 235/492 |
| 2013/0293424 | A1* | 11/2013 | Zhu | H01Q 1/243 343/702 |

(Continued)

FOREIGN PATENT DOCUMENTS

| | | |
|---|---|---|
| TW | I421775 | 1/2014 |
| TW | I446627 | 7/2014 |

*Primary Examiner* — Hai V Tran
*Assistant Examiner* — Michael M Bouizza

(57) ABSTRACT

A slot antenna structure for an electronic tag includes a dielectric layer, a conductor layer, a slot area and a capacitance adjustment unit. The electronic tag includes an identification chip. The conductor layer is disposed on the dielectric layer. The slot area is disposed in the conductor layer and includes an open slot, an open end and at least one closed slot. The open end is located at an edge of the conductor layer and extends inwardly to form the open slot for disposing the identification chip. The open slot has two sidewalls, and the two sidewalls have at least one turning point at a bottom portion of the open slot to form the closed slot. The capacitance adjustment unit is disposed on a surface of the dielectric layer different from the conductor layer to correspond to the slot area, thereby generating a capacitance effect.

21 Claims, 11 Drawing Sheets

(56) References Cited

U.S. PATENT DOCUMENTS

2014/0062818 A1* 3/2014 Tsai ..... H01Q 5/335
343/746
2016/0104938 A1* 4/2016 Hsu ..... H01Q 13/106
343/767

* cited by examiner

SLOT ANTENNA STRUCTURE FOR ELECTRONIC TAG

FIELD OF THE INVENTION

The present invention relates to a slot antenna structure, and more particularly to a slot antenna structure for an electronic tag.

BACKGROUND OF THE INVENTION

Radio frequency identification (RFID), also known as electronic tag, is a wireless communication technology that can be identified or perform data exchange with a read and write device through radio waves. An electronic tag mainly includes an antenna and an identification chip. In order to reduce the size and cost, many electronic tags use passive power design, which means that the power source of the identification chip is generated by microwave resonance or electromagnetic induction by using the antenna or coil to sense the radio waves or magnetic fields sent from the read and write devices.

Many industries use electronic tags. For example, electronic tags may be attached to a car in production, and therefore, the progress of the car in the production line can be tracked; through electronic tags, warehouse can track the location of items and logistics management can be facilitated; electronic tags may be set on the identification card for access control management, installed in the car for collecting road toll and parking fees, installed in livestock or wildlife for identification, or linked to electronic records of patients. The use of electronic tags is very broad.

For longer distance communications, an antenna is used for general wireless transmission. Specifically, radio waves produce microwave resonance first. The antenna, after receiving the radio waves from a read and write device, then transmits the radio waves to the modulation circuit and power control circuit in the identification chip. The power control circuit converts the transmitted AC into DC as the power sources of the components in the identification chip. After obtaining the power source, logic unit starts to process the received data. Once the processing is completed, the logic unit modulates the result by the modulation circuit, and then transmits back to the remote read and write device through the antenna. Thus, the power supply and data exchange functions are completed.

Design of the antenna of an electronic tag requires that the antenna has a frequency band matching with the radio waves, to generate sufficient power by induction, and to consider the gain effect and read field shape. Further, to consider the antenna impedance matching, increase the communication distance, optimize the read rate of data, and consider the application of miniaturization, the type of the antenna must be designed specific to such purposes.

Accordingly, one objective of the present invention to provide a slot antenna structure for use in an electronic tag, which achieves the above-mentioned objectives and solves the problems in the prior art.

SUMMARY OF THE INVENTION

One objective of the present invention is to provide a slot antenna structure for an electronic tag that produces a desired impedance matching in a slot design to achieve a desired communication effect and to minimize the overall volume.

The present invention relates to a slot antenna structure for an electronic tag. The electronic tag has an identification chip. The slot antenna structure includes a dielectric layer, a conductor layer, a slot area and a capacitance adjustment unit.

The conductor layer is disposed on the dielectric layer. The slot area is disposed in the conductor layer and includes an open slot, an open end and at least one closed slot. The open end is located at an edge of the conductor layer and extends inwardly to form the open slot for disposing the identification chip. The open slot has two sidewalls and the two sidewalls have at least one turning point at a bottom portion of the open slot to form the closed slot. The capacitance adjustment unit is disposed in the open slot or on a surface of the dielectric layer different from the conductor layer to correspond to the slot area, thereby generating a capacitance effect.

The aforementioned slot antenna structure can be presented in various embodiments. In the slot antenna structure according to one embodiment, the slot area includes two closed slots, the two sidewalls oppositely extend from the bottom portion of the open slot to form the two closed slots, the conductor layer between the two closed slots and the open slot forms a symmetrical dipole structure, and the capacitance adjustment unit is disposed on the surface of the dielectric layer different from the conductor layer to correspond to the dipole structure.

Further, each of the closed slots has an end and at least two of the turning points, and an area of the end of each of the closed slots is larger than a specific value so that a size of the dipole structure is identical to a size of the capacitance adjustment unit. Moreover, an end of each of the closed slots has a depressed portion so that the dipole structure has a symmetrical L-shape.

In the slot antenna structure according to one embodiment, the slot area further includes a through hole disposed adjacent to the open slot, the conductor layer between the open slot and the closed slot forms a part of the dipole structure, another part of the dipole structure is disposed on the surface of the dielectric layer different from the conductor layer as the capacitance adjustment unit, and the part of the dipole structure is electrically connected to the other part of the dipole structure via the through hole, so that a capacitance effect is formed between the part of the dipole structure and the other part of the dipole structure overlapping with the projection of the part of the dipole structure.

In one embodiment, the capacitance adjustment unit is a conductor structure. In another embodiment, the capacitance adjustment unit is a capacitive element, and the capacitive element is disposed in the opening slot.

Therefore, by utilizing the slot antenna structure for use in the electronic tag of the present invention having the open slot and the closed slot of various designs, the impedance of the slot antenna structure can be adjusted to match the desired impedance matching and the overall volume of the slot antenna structure can be further miniaturized in conjunction with the capacitance effect generated between the dipole structure and the capacitance adjustment unit and further in conjunction with the location of the identification chip.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
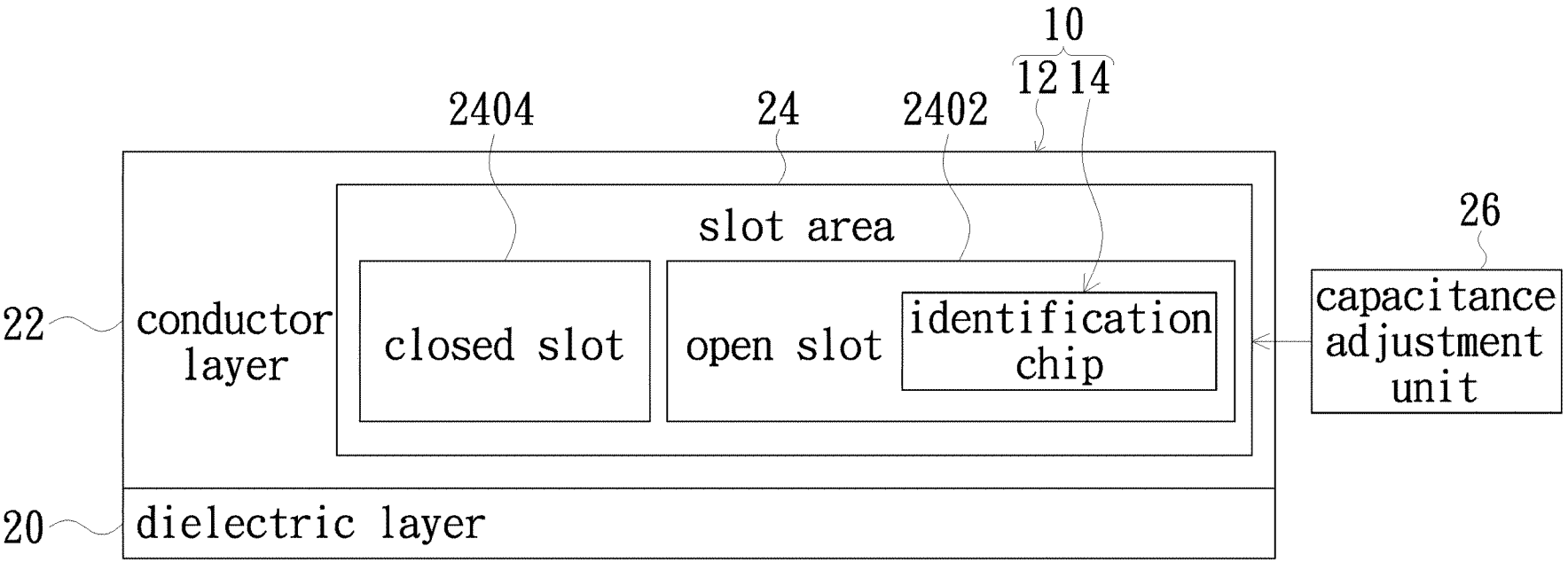
FIG. 1 is a schematic functional block view of a slot antenna structure in an electronic tag in accordance with an embodiment of the present invention.

Please refer to FIG. 1, which is a schematic functional block view of a slot antenna structure 12 in an electronic tag 10 in accordance with an embodiment of the present invention. The present invention relates to the slot antenna structure 12 for use in the electronic tag 10. The electronic tag 10 is disposed in a circuit board (not shown) such as a single-layered printed circuit board or a multi-layered printed circuit board, but the present invention is not limited thereto. Further, a surface of the circuit board is provided with a clearance area disposed on a dielectric layer of the circuit board and at the edge of the circuit board, in addition to a wiring conductor layer with the electronic components disposed on the dielectric layer. The electronic tag 10 is disposed in the clearance area. The other surface of the circuit board also has a wiring conductor layer with electronic components disposed on the dielectric layer but not having a clearance area. The tag 10 has an identification chip 14 in addition to the slot antenna structure 12. The slot antenna structure 12 includes a dielectric layer 20, a conductor layer 22, a slot area 24 and a capacitance adjustment unit 26. The slot area 24 is located at the edge of the circuit board. The conductor layer 22 is disposed on the dielectric layer 20. The conductor layer 22 may be a metal layer such as a copper layer, an aluminum layer, etc. The dielectric layer 20 is mostly made of an insulating material, such as glass fiber or resin. In one embodiment of the present invention, the conductive layer 22 and the dielectric layer 20 of the slot antenna structure 12 may be a conductor layer and a dielectric layer of a circuit board, respectively.

The slot area 24 is disposed in the conductor layer 22. The slot area 24 is manufactured in such a manner as to, for example, etch the conductor layer 22 to expose the dielectric layer 20, or avoid the slot area 24 to form the conductor layer 22 on the surface of the dielectric layer 20 by printing. The slot area 24 further includes an open slot 2402, an open end (which will be shown in FIG. 3A) and at least one closed slot 2404. The open end is located at the edge of the conductor layer 22 and extends inwardly to form the open slot 2402 for disposing the identification chip 14. The open slot 2402 has two sidewalls that have at least one turning point at the bottom portion of the open slot 2402 for forming the closed slot 2404.

The capacitance adjustment unit 26 is disposed in the open slot 2402, or disposed on the surface of the dielectric layer 20 different from the conductor layer 22 to correspond to the slot area 24, thereby generating a capacitance effect. Further, the capacitance adjustment unit 26 is disposed on the dielectric layer of the other surface of the circuit board to correspond to the slot area 24, thereby generating a capacitance effect, so as to achieve impedance matching of the slot antenna structure 12, which benefits the miniaturized design of the slot antenna structure 12. The conductor layer 22 is a radiating element which, after receiving a radio wave from a read and write device, resonates to generate a current supply to operate the identification chip 14 and transmits the information of the identification chip 14 as a radio wave. The present invention provides a number of embodiments for the form and disposition of the capacitance adjustment unit 26, but is not limited thereto and may vary depending on the needs of the user.

Figure 2:
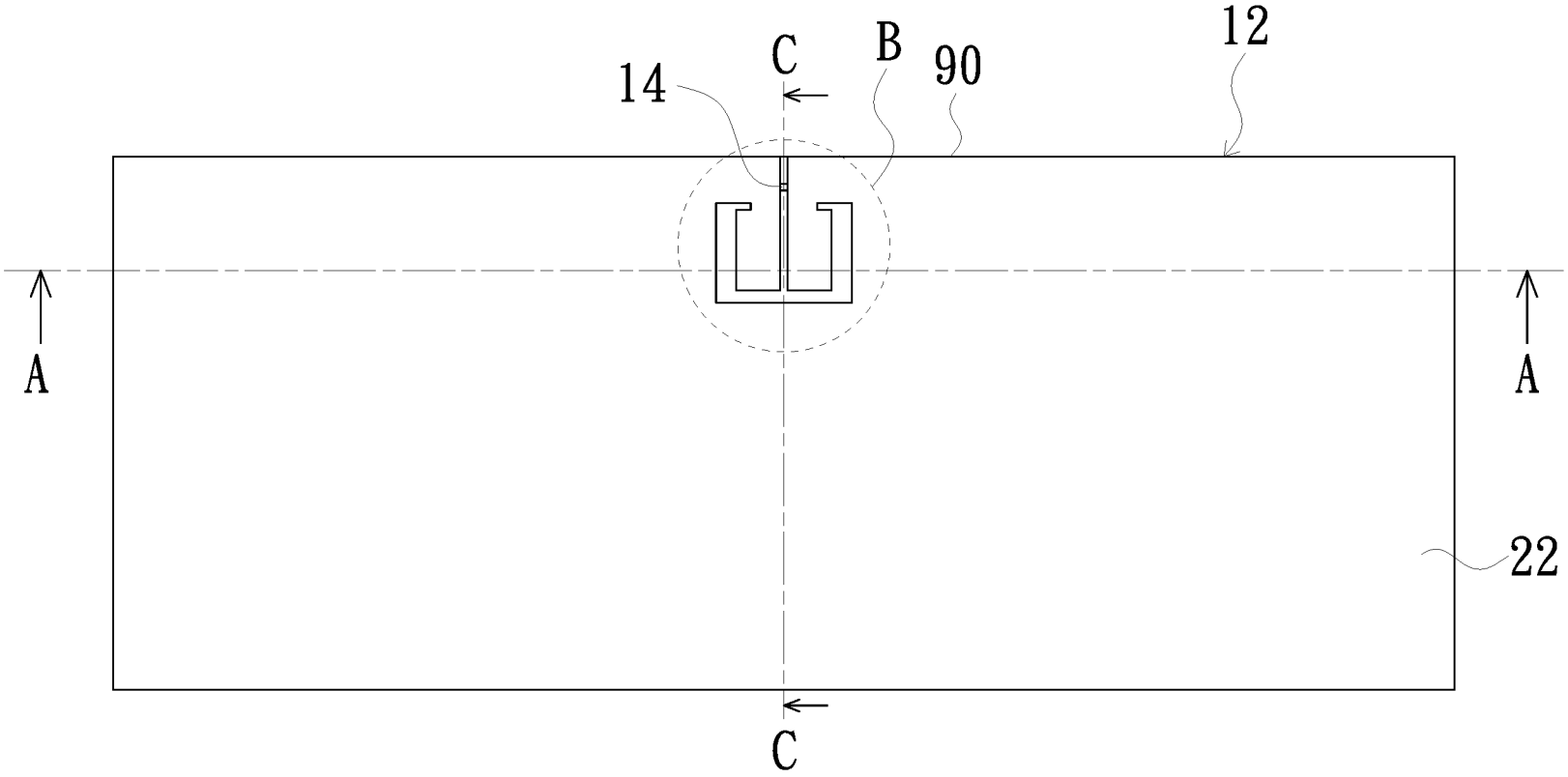
FIG. 2 is a schematic view of a slot antenna structure in accordance with the first embodiment of the present invention.
Figure 3A:
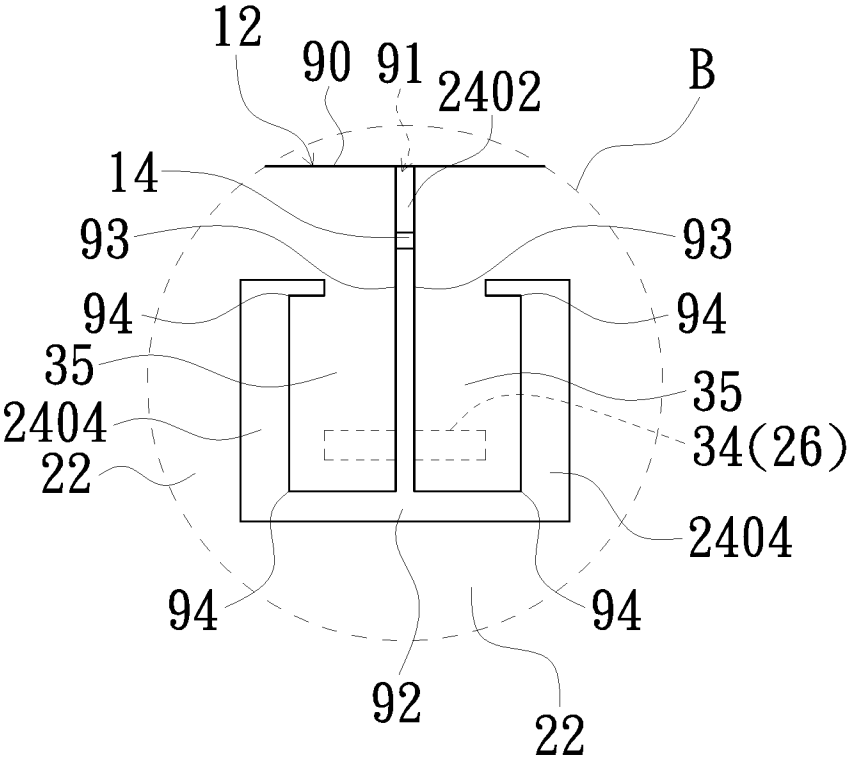
FIG. 3A is an enlarged schematic view of area B in FIG. 2.
Figure 3B:
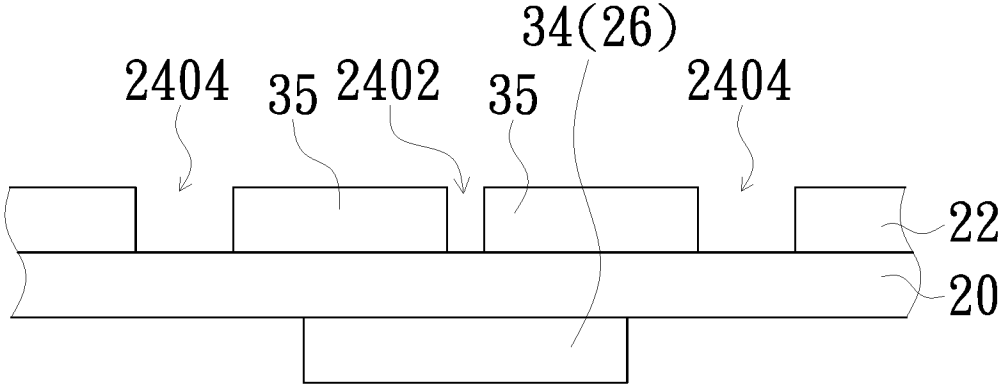
FIG. 3B is an enlarged cross-sectional view of FIG. 2 taken along line A-A.
Figure 3C:
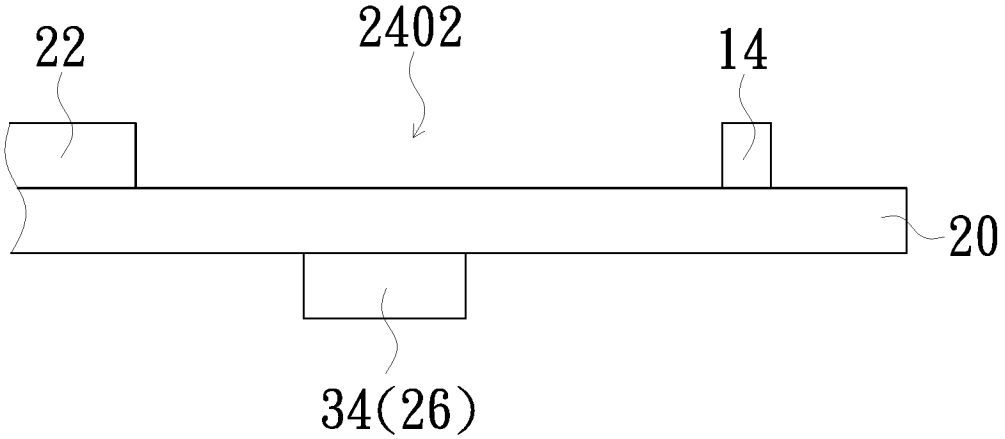
FIG. 3C is an enlarged cross-sectional view of FIG. 2 taken along line C-C.

Please refer to FIGS. 2, 3A, 3B and 3C. FIG. 2 is a schematic view of the slot antenna structure 12 in accordance with the first embodiment of the present invention. FIG. 3A is an enlarged schematic view of the area B in FIG. 2. FIG. 3B is an enlarged cross-sectional view of FIG. 2 taken along line A-A. FIG. 3C is an enlarged cross-sectional view of FIG. 2 taken along line C-C. Identical to the slot antenna structure 12 shown in FIG. 1, the capacitance adjustment unit 26 of the present embodiment is a conductor structure 34, and the slot area 24 includes an open slot 2402, an open end 91 and two closed slots 2404. The open end 91 is located at the edge 90 of the conductor layer 22 and extends inwardly to form the open slot 2402 for disposing the identification chip 14. The open slot 2402 has two sidewalls 93, which oppositely extend from the bottom portion 92 of the open slot 2402 and each has two turning points 94. The conductor layer 22 between the two closed slots 2404 and the open slot 2402 forms a symmetrical dipole structure 35. In the present embodiment, the identification chip 14 is electrically connected to the dipole structure 35.

In the present embodiment, the conductor structure 34 may be, for example, a metal sheet disposed on the surface of the dielectric layer 20 different from the conductor layer 22 and disposed in a range covered by the projection of the dipole structure 35, so that a capacitance effect is formed between the conductor structure 34 and the dipole structure 35 overlapping with the projection of the conductor structure 34. Further, the conductor structure 34 is disposed on the dielectric layer of the other surface of the circuit board to correspond to the dipole structure 35, thereby generating a capacitance effect between the conductor structure 34 and the dipole structure 35, so as to achieve impedance matching of the slot antenna structure 12 that benefits the miniaturized design of the slot antenna structure 12.

Figure 4A:
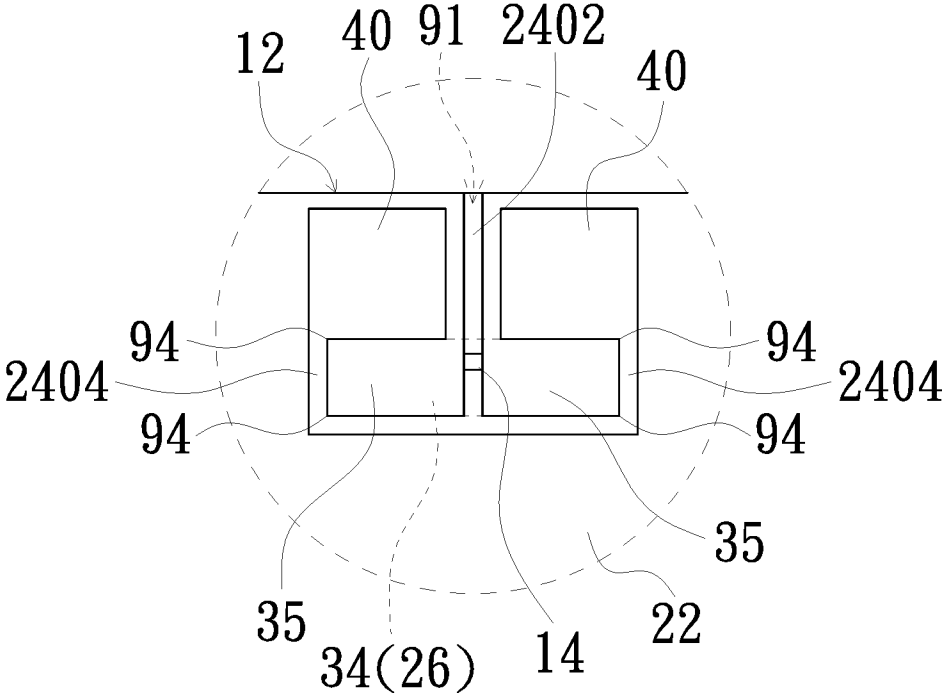
FIG. 4A is an enlarged schematic view of a slot antenna structure in accordance with the second embodiment of the present invention.
Figure 4B:
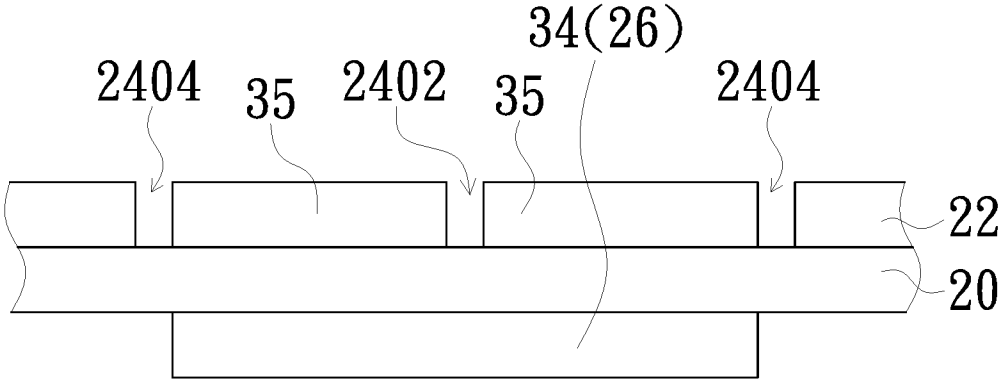
FIG. 4B is a schematic cross-sectional view of the enlarged portion of FIG. 4A.

Please refer to FIGS. 4A and 4B. FIG. 4A is an enlarged schematic view of the slot antenna structure 12 in accordance with the second embodiment of the present invention.

FIG. 4B is a schematic cross-sectional view of the enlarged portion of FIG. 4A. Identical to the slot antenna structure 12 shown in FIG. 1 and similar to the slot antenna structure 12 of the first embodiment, the capacitance adjustment unit 26 of the present embodiment is also a conductor structure 34 and the slot area 24 also includes an open slot 2402, an open end 91 and two closed slots 2404. Different from the first embodiment, the area of the end 40 of each closed slot 2404 of the present embodiment is larger than a specific value so that the size of the dipole structure 35 between the closed slots 2404 and the open slot 2402 is identical to that of the capacitance adjustment unit 26, but the present invention is not limited thereto. The user may adjust the area of the end 40 of the closed slot 2404 in accordance with the desired impedance of the slot antenna structure 12 to match the desired impedance matching. In the present embodiment, the identification chip 14 is disposed in the open slot 2402 and electrically connected to the dipole structure 35.

Figure 5:
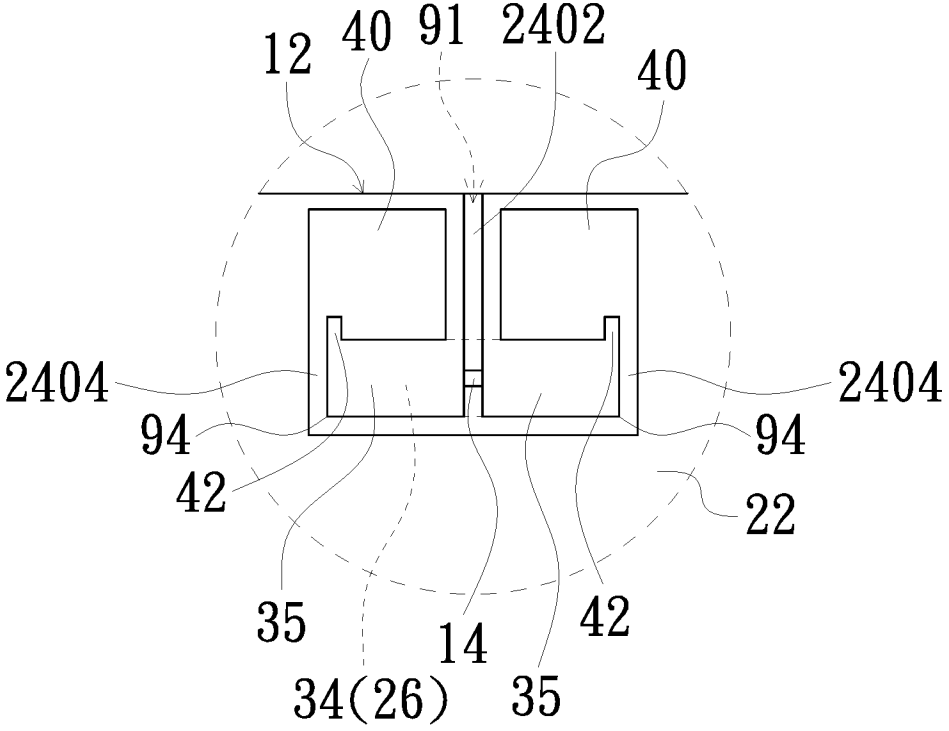
FIG. 5 is an enlarged schematic view of a slot antenna structure in accordance with the third embodiment of the present invention.

Please refer to FIG. 5, which is an enlarged schematic view of the slot antenna structure 12 in accordance with the third embodiment of the present invention. Identical to the slot antenna structure 12 shown in FIG. 1 and similar to the slot antenna structure 12 of the second embodiment, a depressed portion 42 may further be formed at the end 40 of each closed slot 2404 in FIG. 4A depending on the requirements of the user 42, so that the dipole structure 35 has a symmetrical L-shape. The conductor structure 34 should also be designed to have a symmetrical L-shape in accordance with the shape of the dipole structure 35 to obtain a preferred capacitance effect.

Figure 6:
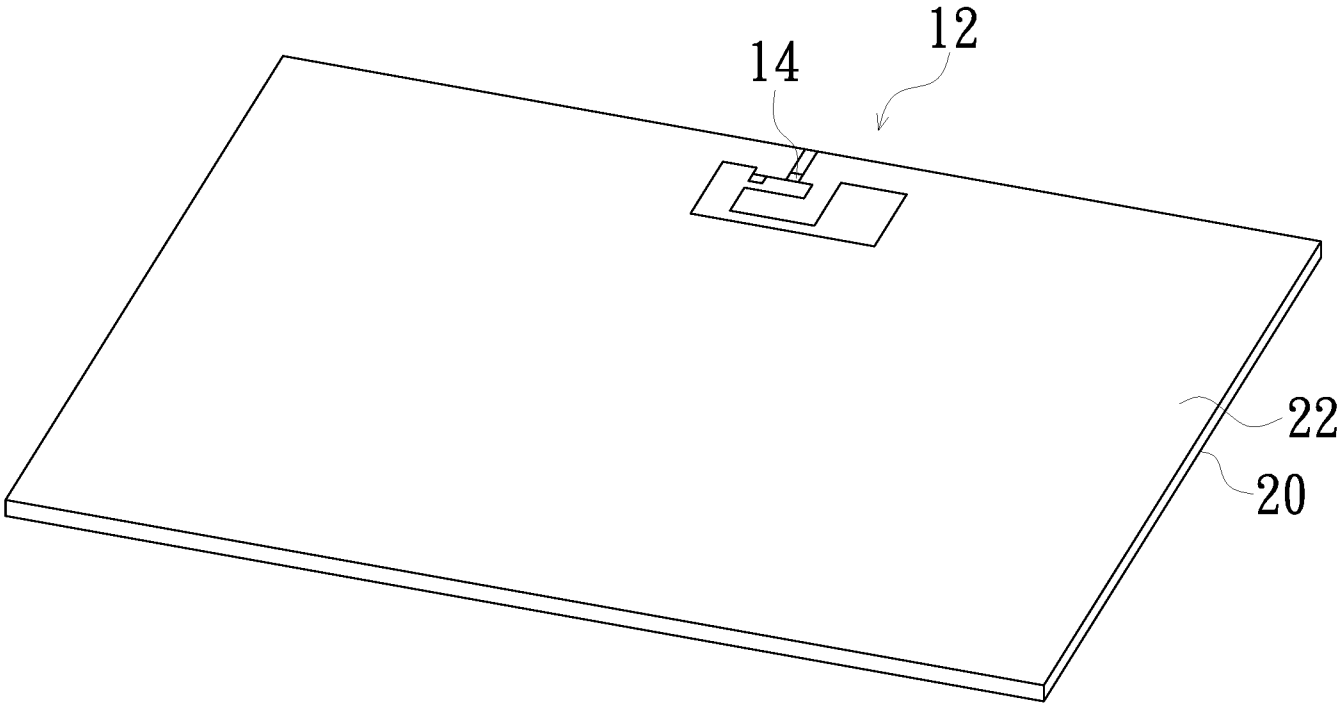
FIG. 6 is a schematic appearance of a slot antenna structure in accordance with the fourth embodiment of the present invention.
Figure 6A:
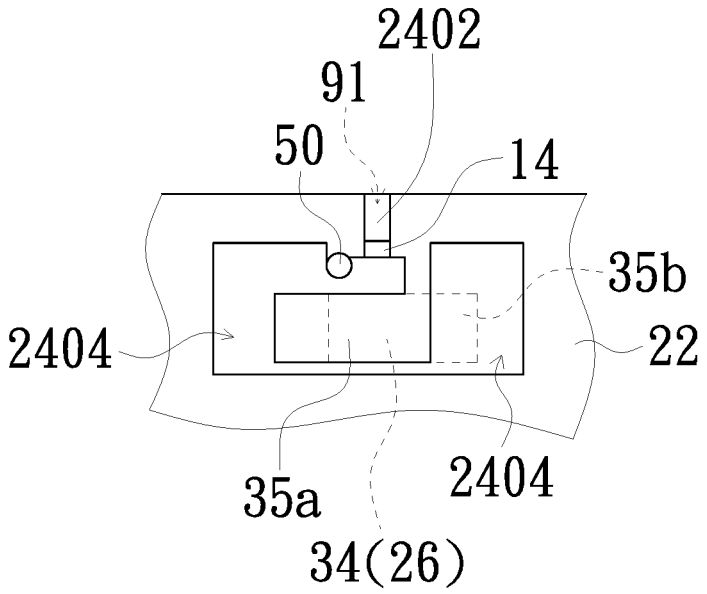
FIG. 6A is a partial enlarged top view of FIG. 6.
Figure 6B:
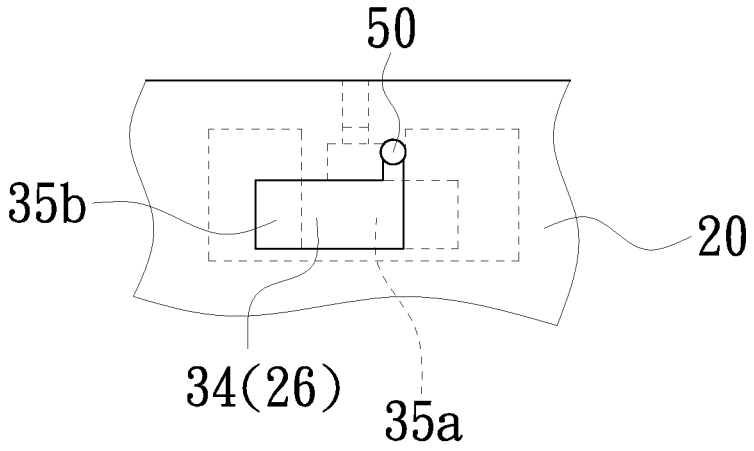
FIG. 6B is a partial enlarged bottom view of FIG. 6.

Please refer to FIG. 6 and in conjunction with FIGS. 6A and 6B. FIG. 6 is a schematic appearance of the slot antenna structure 12 in accordance with the fourth embodiment of the present invention. FIG. 6A is a partial enlarged top view of FIG. 6. FIG. 6B is a partial enlarged bottom view of FIG. 6. Identical to the slot antenna structure 12 shown in FIG. 1, the capacitance adjustment unit 26 of the present embodiment is also a conductor structure 34. As shown in FIG. 6A, the slot area 24 of the present embodiment includes an open slot 2402, an open end 91 and a closed slot 2404. The conductor layer 22 between the open slot 2402 and the closed slot 2404 forms a part of the dipole structure 35*a*. The slot area 24 further has a through hole 50 disposed adjacent to the open slot 2402. As shown in FIG. 6B, another part of the dipole structure 35*b* is disposed on the surface of the dielectric layer 20 different from the conductor layer 22 as the capacitance adjustment unit 26, and the part of the dipole structure 35*a* is electrically connected to the other part of the dipole structure 35*b* via the through hole 50. By such design, a capacitance effect is formed between the part of the dipole structure 35*a* and the other part of the dipole structure 35*b* overlapping with the projection of the dipole structure 35*a*. Further, the other part of the dipole structure 35*b* is disposed on the dielectric layer of the other surface of the circuit board, thereby generating a capacitance effect between the part of the dipole structure 35*a* and the other part of the dipole structure 35*b* overlapping with the projection of the dipole structure 35*a*.

Figure 7:
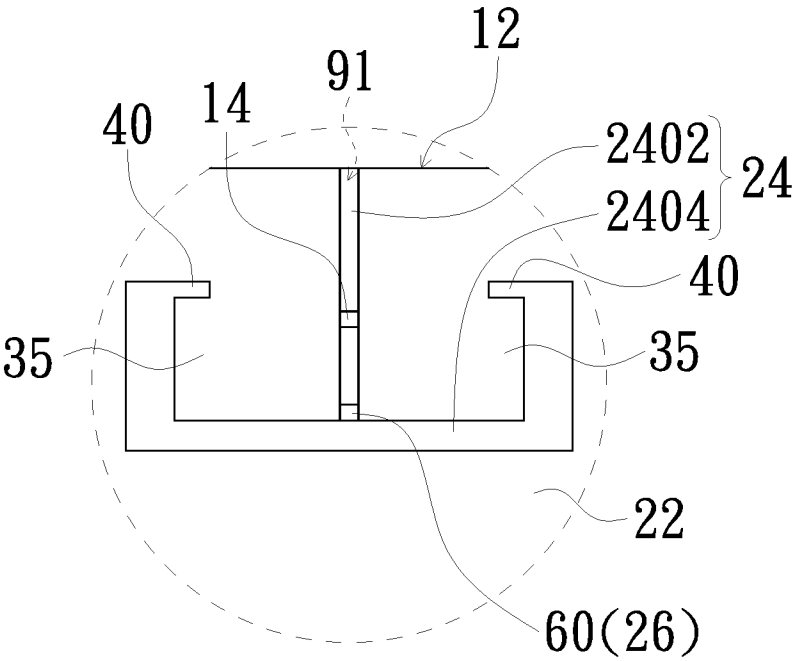
FIG. 7 is an enlarged schematic view of a slot antenna structure in accordance with the fifth embodiment of the present invention.

Please refer to FIG. 7, which is an enlarged schematic view of the slot antenna structure 12 in accordance with the fifth embodiment of the present invention. Identical to the slot antenna structure 12 shown in FIG. 1 and similar to the slot antenna structure 12 of the first embodiment, the slot area 24 of the present embodiment also includes an open slot 2402, an open end 91 and two closed slots 2404, and the conductor layers 22 between the two closed slots 2404 and the open slot 2402 forms a symmetrical dipole structure 35. The difference from the first embodiment is that the capacitance adjustment unit 26 is a capacitive element 60 and is disposed in the open slot 2402, and the identification chip 14 is also disposed in the open slot 2402 and between the open end 91 and the capacitance adjustment unit 26. The user may adjust the position of the capacitance adjustment unit 26 at the opening slot 2402 as needed to adjust the impedance value of the slot antenna structure 12 to match the desired impedance matching. In addition, as previously described, the ends 40 of the closed slot 2404 of the present embodiment may also have an area larger than a specific value, a depressed portion (not shown) may further be formed at the end 40 of each closed slot 2404, so that the dipole structure 35 has a symmetrical L-shape, and no redundant detail is to be given herein.

Thus, by utilizing the slot antenna structure 12 for use in the electronic tag 10 of the present invention having the open slot 2402 and the closed slot 2404 of various designs, the impedance of the slot antenna structure 12 can be adjusted to match the desired impedance matching and the overall volume of the slot antenna structure 12 can be further miniaturized in conjunction with the capacitance effect generated between the dipole structure 35 and the capacitance adjustment unit 26 and further in conjunction with the location of the identification chip 14.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A slot antenna structure for an electronic tag, the electronic tag comprising an identification chip, and the slot antenna structure comprising:

a dielectric layer;

a conductor layer, disposed on the dielectric layer;

a slot area, disposed in the conductor layer and comprising an open slot, an open end and at least one closed slot, wherein the open end is located at an edge of the conductor layer and extends inwardly to form the open slot for disposing the identification chip, the open slot has two sidewalls, and the two sidewalls have at least one turning point at a bottom portion of the open slot to form the closed slot; and a capacitance adjustment unit, disposed on a surface of the dielectric layer different from the conductor layer to correspond to the slot area, thereby generating a capacitance effect, wherein the electronic tag is disposed in a circuit board, a surface of the circuit board comprises a wiring conductor layer disposed on a dielectric layer of the circuit board and a clearance area disposed on the dielectric layer of the circuit board and at an edge of the circuit board, and the electronic tag is disposed in the clearance area.

2. The slot antenna structure according to claim 1, wherein the slot area comprises two closed slots, the two sidewalls oppositely extend from the bottom portion of the open slot to form the two closed slots, the conductor layer between the two closed slots and the open slot forms a symmetrical dipole structure, and the capacitance adjustment unit is disposed on the surface of the dielectric layer different from the conductor layer to correspond to the dipole structure.

3. The slot antenna structure according to claim 2, wherein each of the closed slots has an end and at least two of the turning points, and a size of the dipole structure between the closed slots and the open slot is identical to a size of the capacitance adjustment unit.

4. The slot antenna structure according to claim 2, wherein an end of each of the closed slots has a depressed portion so that the dipole structure has a symmetrical L-shape.

5. The slot antenna structure according to claim 4, wherein the capacitance adjustment unit has a symmetrical L-shape corresponding to the dipole structure.

6. The slot antenna structure according to claim 1, wherein the slot area further comprises a through hole disposed adjacent to the open slot, the conductor layer between the open slot and the closed slot forms a first part of the dipole structure, a second part of the dipole structure is disposed on the surface of the dielectric layer different from the conductor layer as the capacitance adjustment unit, and the first part of the dipole structure is electrically connected to the second part of the dipole structure via the through hole, so that the capacitance effect is formed between the first part of the dipole structure and the second part of the dipole structure overlapping with a projection of the first part of the dipole structure.

7. The slot antenna structure according to claim 1, wherein the capacitance adjustment unit is a conductor structure.

8. The slot antenna structure according to claim 1, wherein the slot area is disposed at the edge of the circuit board.

9. The slot antenna structure according to claim 1, wherein the conductor layer of the slot antenna structure is the wiring conductor layer of the circuit board, and the dielectric layer of the slot antenna structure is the dielectric layer of the circuit board.

10. The slot antenna structure according to claim 1, wherein another surface of the circuit board has another dielectric layer, and the capacitance adjustment unit is disposed on the other dielectric layer on the other surface of the circuit board to correspond to the slot area.

11. The slot antenna structure according to claim 1, wherein the circuit board is a single-layered printed circuit board or a multi-layered printed circuit board.

12. The slot antenna structure according to claim 1, wherein the slot area is disposed in the conductor layer and the slot area is manufactured to expose the dielectric layer.

13. A slot antenna structure for an electronic tag, the electronic tag comprising an identification chip, and the slot antenna structure comprising:

a dielectric layer;

a conductor layer, disposed on the dielectric layer;

a slot area, disposed in the conductor layer and comprising an open slot, an open end and at least one closed slot, wherein the open end is located at an edge of the conductor layer and extends inwardly to form the open slot for disposing the identification chip, the open slot has two sidewalls, and the two sidewalls have at least one turning point at a bottom portion of the open slot to form the closed slot; and a capacitance adjustment unit, disposed in the open slot to generate a capacitance effect, wherein the electronic tag is disposed in a circuit board, a surface of the circuit board comprises a wiring conductor layer disposed on a dielectric layer of the circuit board and a clearance area disposed on the dielectric layer of the circuit board and at an edge of the circuit board, and the electronic tag is disposed in the clearance area.

14. The slot antenna structure according to claim 13, wherein the slot area comprises two closed slots, the two sidewalls oppositely extend from the bottom portion of the open slot to form the two closed slots, and the conductor layer between the two closed slots and the open slot forms a symmetrical dipole structure.

15. The slot antenna structure according to claim 14, wherein each of the closed slots has an end and at least two of the turning points.

16. The slot antenna structure according to claim 14, wherein an end of each of the closed slots has a depressed portion so that the dipole structure has a symmetrical L-shape.

17. The slot antenna structure according to claim 13, wherein the capacitance adjustment unit is a capacitive element.

18. The slot antenna structure according to claim 13, wherein the slot area is disposed at the edge of the circuit board.

19. The slot antenna structure according to claim 13, wherein the conductor layer of the slot antenna structure is the wiring conductor layer of the circuit board, and the dielectric layer of the slot antenna structure is the dielectric layer of the circuit board.

20. The slot antenna structure according to claim 13, wherein the circuit board is a single-layered printed circuit board or a multi-layered printed circuit board.

21. The slot antenna structure according to claim 13, wherein the slot area is disposed in the conductor layer and the slot area is manufactured to expose the dielectric layer.

* * * * *